United States Patent [19]

Ishihara et al.

[11] Patent Number: 4,941,377

[45] Date of Patent: Jul. 17, 1990

[54] APPARATUS FOR FEEDING A CONTINUOUS FORM AND CUTFORMS

[75] Inventors: Takeyuki Ishihara, Tokohama; Tetsuo Kanno, Fujisawa, both of Japan

[73] Assignee: International Business Machines Corporation, Armonk, N.Y.

[21] Appl. No.: 248,682

[22] Filed: Sep. 23, 1988

[30] Foreign Application Priority Data

Oct. 9, 1987 [JP] Japan ..... 62-253926

[51] Int. Cl.[5] ..... B26D 5/28; B41J 11/00

[52] U.S. Cl. ..... 83/211; 83/278; 83/364; 83/370; 83/423; 83/650; 355/310; 226/110; 271/9

[58] Field of Search ..... 83/209, 210, 211, 272, 83/278, 280, 364, 370, 423, 648, 650; 198/448; 355/13, 29; 271/9; 226/110

[56] References Cited

U.S. PATENT DOCUMENTS

| | | | |
|---|---|---|---|
| 3,435,717 | 4/1969 | Macomber | 83/278 X |
| 3,645,157 | 2/1972 | Di Giulio et al. | 83/205 |
| 4,452,543 | 6/1984 | Adkisson et al. | 271/9 X |
| 4,488,829 | 12/1984 | Hidaka | 271/9 X |
| 4,564,305 | 1/1986 | Rekewitz et al. | 271/9 X |
| 4,754,960 | 7/1988 | Muller | 271/9 |

FOREIGN PATENT DOCUMENTS

| | | | |
|---|---|---|---|
| 52-5650 | 2/1977 | Japan . | |
| 53-33562 | 8/1978 | Japan . | |
| 57-38175 | 3/1982 | Japan . | |
| 0082250 | 5/1984 | Japan | 271/9 |
| 62-7634 | 2/1987 | Japan . | |

*Primary Examiner*—Frank T. Yost
*Assistant Examiner*—Eugenia A. Jones
*Attorney, Agent, or Firm*—John J. McArdle, Jr.

[57] ABSTRACT

A continuous form and cutform feeding unit for a printer. The feeding unit permits feeding a continuous form and cutforms utilizing a cutform feeding arrangement and a continuous form tractor feed. In order to permit either type of form to be fed to a main body of a printer, through a single form feeding passage, a cutform feeding passage and a continuous form feeding passage are provided upstream of the single form feeding passage. In the continuous form feeding passage, a continuous form cutting apparatus is operable to cut a continuous form in response to a signal such as for the beginning of the feeding of cutforms.

4 Claims, 5 Drawing Sheets

APPARATUS FOR FEEDING A CONTINUOUS FORM AND CUTFORMS

BACKGROUND OF THE INVENTION

This invention relates to an apparatus for feeding a continuous form and cutforms which can be mounted on and removed from the main body of a business machine and is unitized with a continuous-form cutting means, or cutter.

Up to now, in expensive printers such as high-speed electrophotographic printers, there have been only printers dedicated to continuous forms and those dedicated to cutforms, and a user wanting to print on both types of forms has needed to purchase the two dedicated machines, which imposed a large burden on the user.

In small-sized impact terminal printers, a paper feed unit dedicated to cutforms, which is separately sold as an automatic sheet feeder mechanism and can be mounted on and removed from the main body of a printer, and a paper ejecting tractor dedicated to continuous forms are used. If the user purchases the necessary feed units, he can print on both continuous forms and cutforms with a single printer. However, the user or the operator must change the feed units by mounting and removing them one by one, depending on the kind of the form to be printed upon. Also, in switching from a continuous form to cutforms, the operator is required to manually cut and remove the continuous form.

The Japanese Published Unexamined Patent Application No. 57-38175 discloses a printer provided with a mechanism for feeding a continuous form and manually inserted cutforms in the printer main body, but it does not disclose a unitized form feeding unit at all. Such a printer will result in the user who is satisfied with a form feeding mechanism for either continuous forms or cutforms purchasing an unnecessary feed mechanism for the other type of form, which is rather expensive. Moreover, the above-mentioned application discloses a cutter which can cut off the continuous forms after being printed so that they can be used as accounting slips, but it does not suggest a construction which can automatically cut a continuous form in response to an electrical signal for the purpose of form changing.

In the field of copying machines, a unitized paper feed unit is disclosed in the Japanese Utility Model Registration Publication No. 62-7634, but an apparatus for feeding cutforms and a continuous form, which is the object of this invention, is not mentioned, and even handling a continuous form is not suggested at all.

For copying machines using a roll paper, the Japanese Utility Model Registration Publication Nos. 52-5650 and 53-33562 are known, but in either of these, the roll paper is periodically and inevitably cut and fed to the copying portion. Thus, the technology in the field of copying machines suggests nothing about feeding a continuous form, a concept usually specific to the field of printers, to the printing portion. Incidentally, the above-mentioned two utility model registration publications suggest nothing about unitizing the paper feeding portion.

As described above, because, up to now, there was no printer which could be used by freely changing a continuous form and cutforms without operator intervention, and particularly because, as a printer to be directly connected to a computer, there was no printer which could handle both continuous forms and cutforms with one unit, the user needed to purchase two printers to print on both continuous forms and cutforms.

Also, a small-sized impact terminal printer which can handle both continuous forms and cutforms required operator intervention for changing the forms.

On the other hand, treatment of both continuous forms and cutforms in one printer resulted in a user who used only one type of form having to incur an extra expense for the unnecessary mechanism. Also there was fear of incomplete functionality if an attempt at functional services was made in a limited space.

SUMMARY OF THE INVENTION

Accordingly, an object of this invention is to provide a novel apparatus for feeding a continuous form and cutforms wherein, by unitizing the form feed portion according to the combination of the forms to be used by the user, the range of user choice is widened to lighten the user's expense burden, and simultaneously neither changing of the feed unit nor operator intervention is required in switching between a continuous form and cutforms.

The above object is accomplished in one form of the invention by an apparatus 10 for feeding a continuous form and cutforms wherein a cutform feeding means 11 and a tractor 13 for feeding a continuous form are provided in one unit as shown in FIG. 1. Further, in this invention, for allowing either form to be fed to a printer main body 50 through a single form feeding passage 14, a cutform feeding passage 15 and a continuous-form feeding passage 16 are provided upstream thereof. In the continuous-form feeding passage 16, a continuous-form cutting means 17 is provided which can cut a continuous form in response to a signal to be given when necessary. This enables the saving of the time for the operator to cut the continuous form when switching from the continuous form to cutforms, and simultaneously enables automatic switching. In addition, the form receiving port and the form feeding path at the printer side are sufficient if they can be connected to the single form feeding passage 14, and can also commonly be used when another unitized feeding apparatus dedicated to continuous forms or cutforms is loaded, so that they become simple in construction and inexpensive.

DETAILED DESCRIPTION

Figure 2:
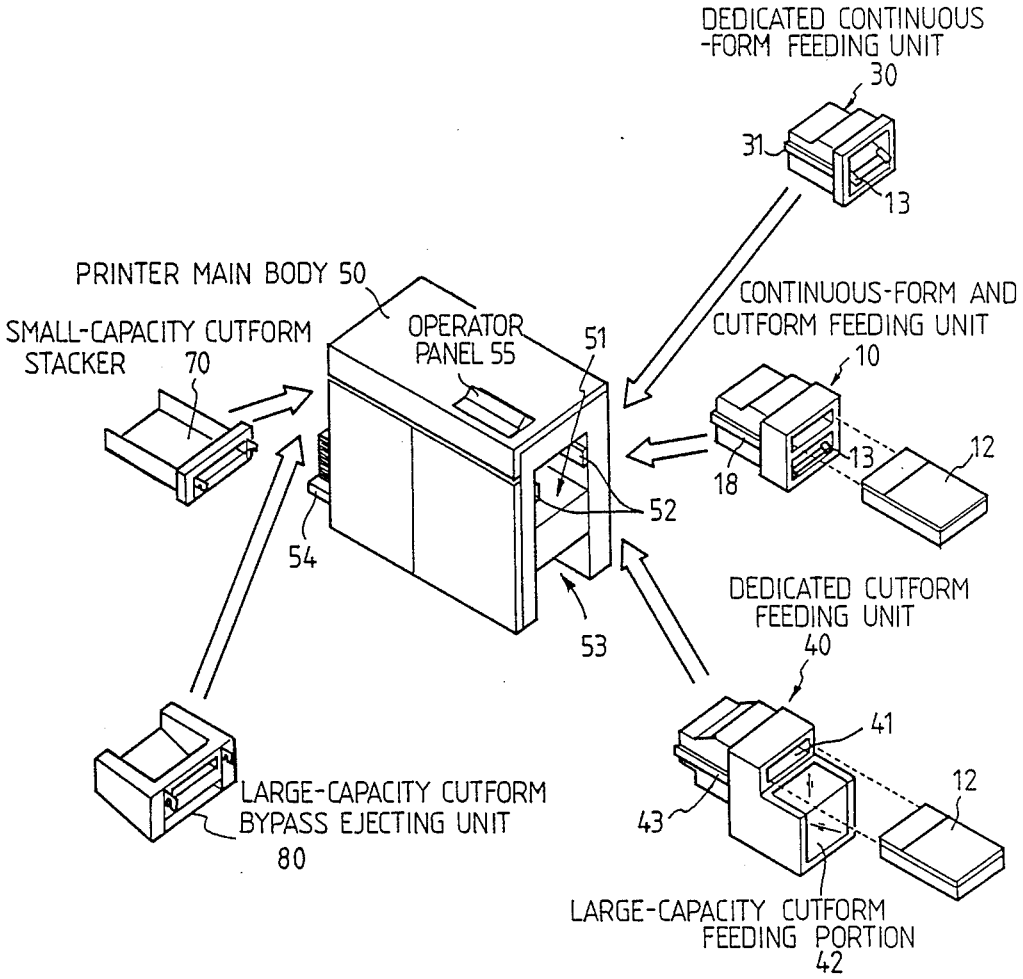
FIG. 2 shows how to combine the printer main body with various form feeding units.

FIG. 2 shows how to combine the printer main body 50 with various form feeding units. That is, a user using only continuous forms may purchase a dedicated continuous-form feeding unit 30 including a tractor 13. The unit 30 is mounted in a portion 51 of the printer main body 50 for receiving a form feeding unit. When the unit 30 is received in the portion 51 of the printer main body 50, the guides 31, 52 of the unit 30 and the portion 51 slide relative to each other. Similarly, a user using only cutforms may purchase a dedicated cutforms feeding unit 40 and mount it in the printer main body 50 using the guides 43, 52.

The dedicated cutforms feeding unit 40 includes a form cassette receiving portion 41 for receiving a cassette 12 containing a small capacity of forms and a large-capacity cutform feeding portion 42, and can feed cutforms from either portion to the printer main body 50 from the only form feeding passage (not shown). A user using both continuous forms and cutforms has only to purchase only the continuous-form and cutforms feeding unit 10 of this invention, and can use it by mounting the unit 10 in the portion 51 of the printer main body 50 for receiving a form feeding unit while sliding the guides 18, 52 of the unit 10 and the portion 51 relative to one another.

At this time, an electrical connection to the printer main body as well as a physical connection is made by connector pins or the like. The continuous forms to be fed occupy no room if they are contained in a space 53 of the printer main body 50 for containing continuous forms. Further, the continuous forms after printing are ejected into a continuous-form stacker 54 provided in the printer main body 50. The cutforms after printing are ejected into a small-capacity cutform stacker 70, which can be mounted on and removed from the printer main body 50. Since a large-capacity stacker is required when the dedicated cutform feeding unit 40 is utilized, cutforms may be contained in the continuous-form stacker 54. When the continuous-form ejecting passage in the printer main body 50 cannot be used as the passage for cutforms, a large-capacity cutform bypass ejecting unit 80, a unit which can be mounted on and removed from the printer main body 50, may be mounted at the form exit to the small-capacity cutform stacker 70 instead of adding an extra passage to the printer main body. If a U-turn passage is provided in the large-capacity cutform bypass ejecting unit 80, the cutforms to be ejected into the continuous-form stacker 54 are ejected in the order in which they were printed with the printed faces down.

Figure 3:
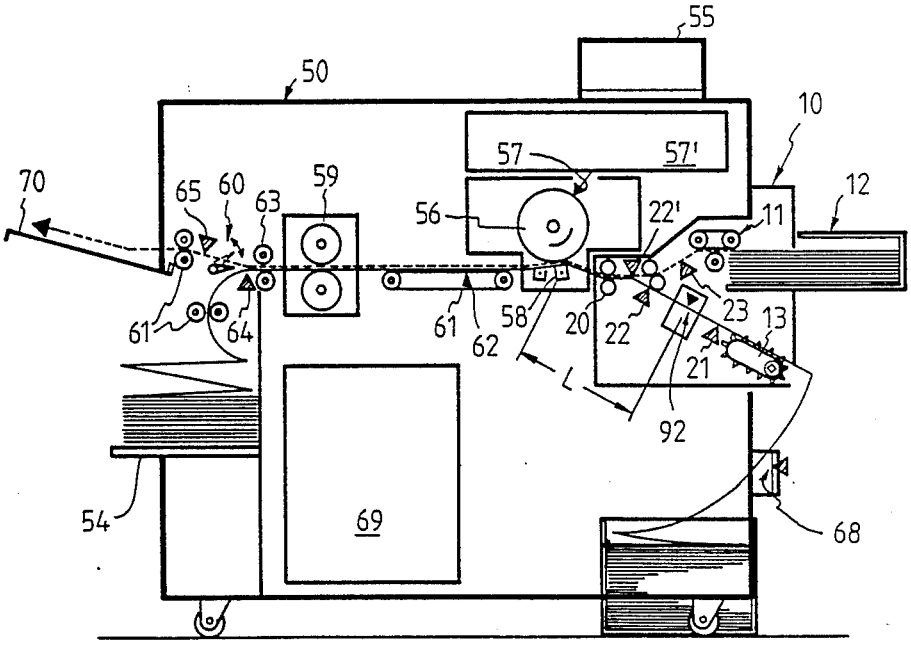
FIG. 3 shows the passages for forms in the entire printer system along with the construction of the printing portion of the printer main body and various form sensors.

FIG. 3 shows the passage for forms where the small-capacity cutform stacker 70 and the cutform and continuous-form feeding unit 10 of this invention are attached to the printer main body 50, together with the construction of the printing portion of the printer main body 50 and various form sensors.

The printing portion of the printer main body 50, as is well known, forms a latent image of data sent from a host processor (not shown) on an electrophotographic drum 56 in a laser writing portion 57 while performing laser scanning with a laser scanner portion 57', develops it with a toner, and transfers it to a form in a transfer portion 58. The printed images on the form to which they were transferred are fused in a fuser portion 59 or the like, and a feeding means 61 at the form ejecting side is used to feed cutforms to the small-capacity stacker 70, and to feed continuous forms to a continuous-form stacker 54 through a form deflecting portion 60. From transfer to fusing, a conveyer belt with a suction port as a vacuum sucking conveyer means which can feed the form while vacuum-sucking the reverse side of the form and a vacuum source are preferably utilized so that the images transferred on the form are not rubbed. This is suitable as the feeding means in the printer main body 50 also from the viewpoint that this can be employed for both continuous forms and cutforms. As to the feeding speed, the cutform and continuous-form feeding unit 10, the electrophotographic drum 56 and the feeding means 61 at the form ejecting side define the feeding speed of cutforms. The feeding speed of a continuous form is defined by the tractor 13 at the side of the unitized apparatus 10 for feeding continuous forms and cutforms. Feed rollers 20 located in the common form feeding passage 14 of the continuous-form and cutforms feeding unit 10 do not engage with a continuous form, but act only on cutforms by control of a motor-driven cam.

Figure 1:
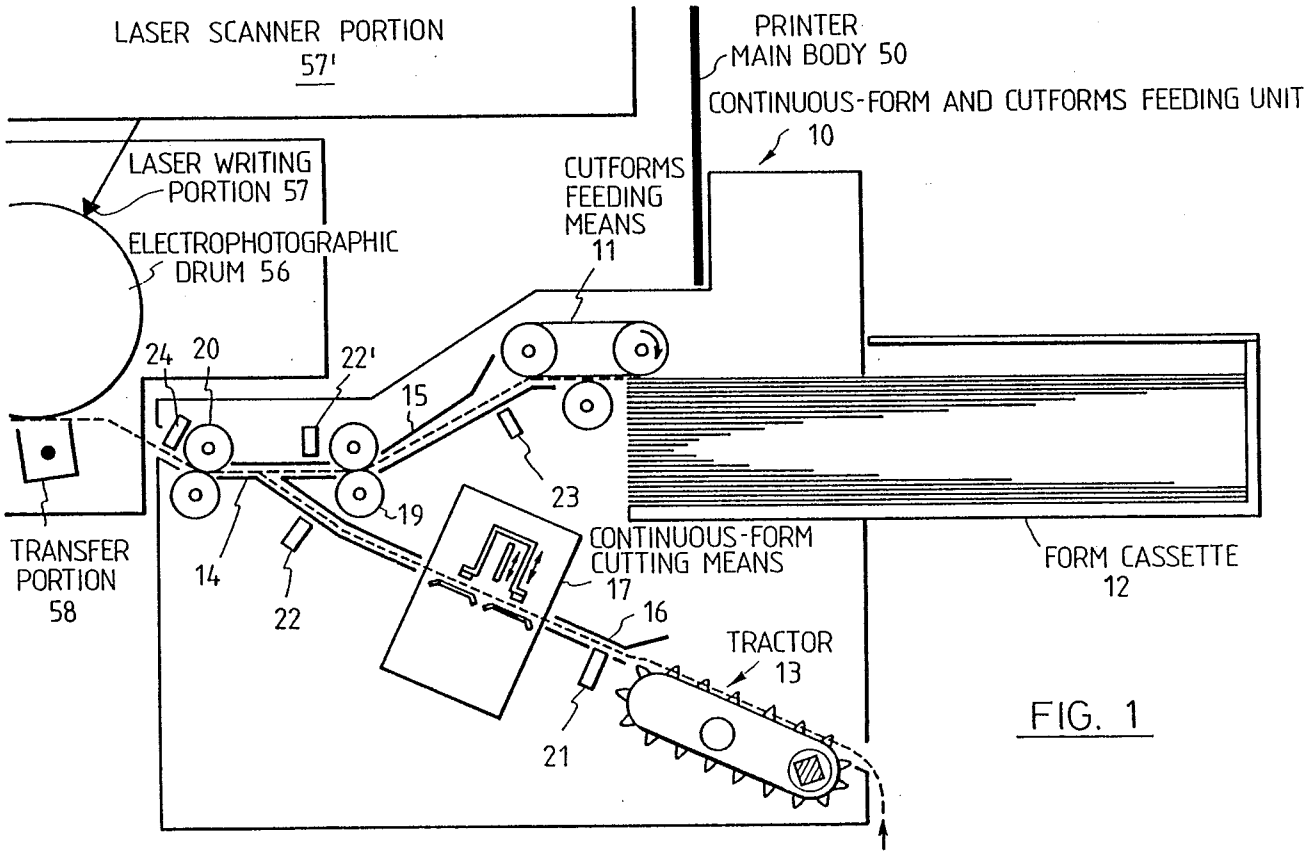
FIG. 1 shows the continuous-form and cutforms feeding unit of this invention.

As shown in FIGS. 1 and 3, the continuous-form and cutform feeding unit 10 of this embodiment includes a continuous-form jam sensor 21 which monitors the movement of the sprocket holes for a continuous form and senses a jam by the stop of the sprocket holes, form edge sensors 22, 22' which sense the incoming of the leading edge of a form to start the laser writing, a cutform feeding sensor 23 which detects the feeding of a cutform and simultaneously checks the trailing edge of the cutform to take the feeding timing of the next cutform or the operation timing of the feeding rollers in the cutforms feeding means 11, and a skew sensor 24 which senses the skew of a cutform and halts the printer if the skew is large. If the distance from the form edge sensors 22, 22' to the transfer portion 58 is set substantially equal to the distance from the laser writing portion 57 to the transfer portion 58, it is easy to control. A sensor which automatically senses the kind of the form cassette 12 or the size of the form at the time of loading the cassette is also included, though it is not shown. Various statuses sensed by these sensors are all communicated to the printer main body 50, as shown in FIG. 4, and used in the printer main body 50.

There are also various sensors in the printer main body 50. A form feed jam sensor 62 examines whether the form arrives within a fixed time from both form edge sensors 22, 22'. A fuser jam sensor 63 is a rotary sensor which senses that the form is stopping in the fuser portion 59. Further, a cutform sensor 64 senses the arrival of the leading edge of the form, from the form feed jam sensor 62, within a predetermined time and the arrival of the trailing edge of that form within a certain time. An exit sensor 65 is similar.

Figure 4:
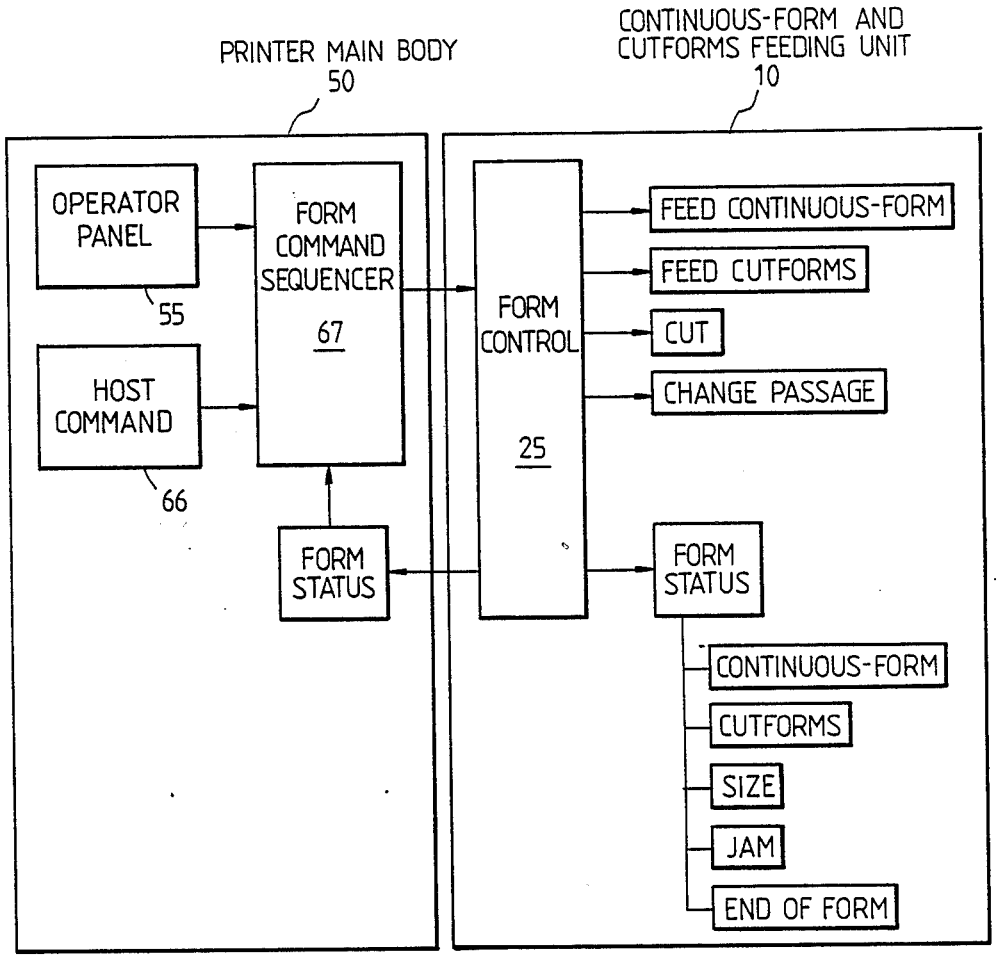
FIG. 4 shows a block diagram illustrating the control relation between the printer main body and the continuous-form and cutforms feeding unit.

As shown in the control block diagram of FIG. 4, whether a continuous form is used or cutforms are used is specified by a command from the host processor or by the switching operation on an operator panel 55. Upon receipt of this specification, a form command sequencer 67, monitoring the above form statuses, issues a command to a form control portion 25 at the continuous-form and cutform feeding unit 10 side, based on that specification, causing it to perform the necessary operation.

The continuous-form cutting means, or cutter, 17 which cuts a continuous form when needed may be an arbitrary means such as one having a fixed or rotary blade or one which separates the form at the perforations as if tearing the form. The preferred example used in this embodiment is shown in FIG. 5.

Figure 5:
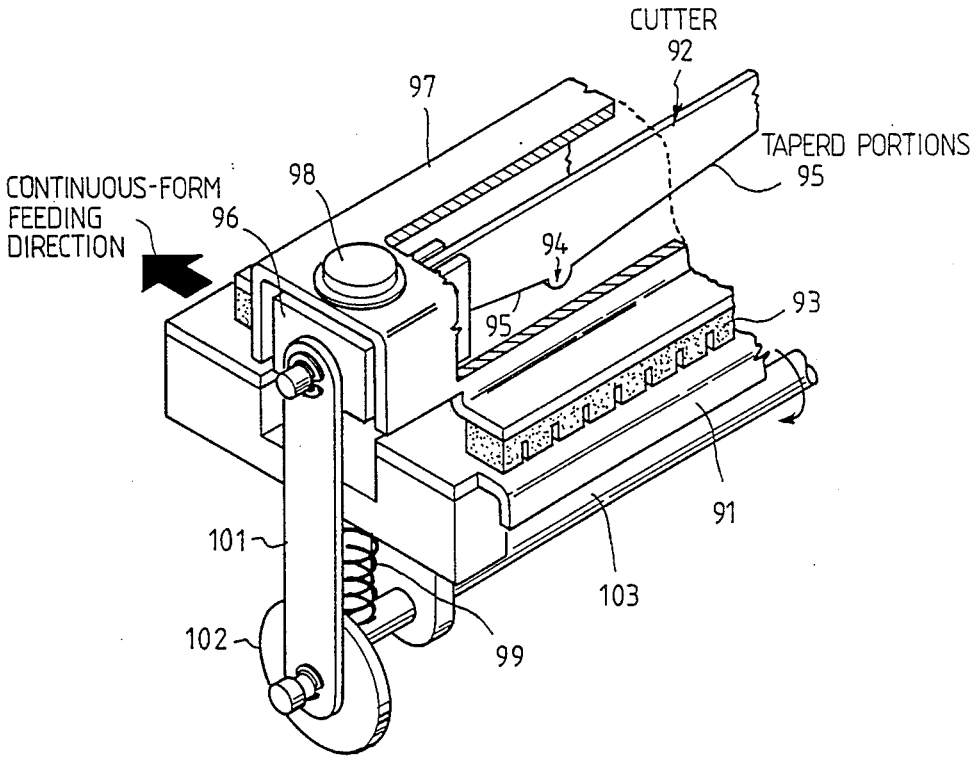
FIG. 5 shows the construction of the embodiment of the continuous-form cutting means.

In the continuous-form cutting means 17 as shown in FIG. 5, a continuous form is fed in the direction of an arrow in the figure on a plate 91, which forms part of the continuous-form feeding passage 16. The cutting means 17 includes a cutter 92 extending in parallel with the perforations in the direction across the continuous-form and paper pressing rubber portions 93 at both ends thereof. The cutter 92 consists of a projecting portion 94, and tapered portions 95 extending to the left and right thereof, and the whole is supported by left and right cutter blocks 96. Also, the paper pressing rubber portions 93 are supported by a paper pressure 97. Further, the cutter block 96 and the paper presses 97 are pressed downward along a guide shaft 98 by a coil spring 99. The cutter block 96 is coupled with a drive shaft 103 via a connecting rod 101 and a crank 102. When the operation is not performed, the crank 102, which is integral with the drive shaft 103, is in the top dead center and pushes up the cutter block 96 and the paper presser 97 thereon through the connecting rod 101 to the highest position against the above-mentioned spring. The continuous form lies between the plate 91 and the paper presser 97, and if the drive shaft 103 is rotated by a motor for the cutter, not shown, when the perforations are located directly under the cutter 92, the paper presser 97 falls along with the cutter block 96 under the operation of the spring has bias force by the coil spring 99. The falling of the paper pressure 97 is blocked in a manner that causes the paper pressing rubber portions 93 to pinch the continuous form against the plate 91. At this time, the spring force of the coil spring 99 serves as the force for pressing the continuous form at both sides of the cutter 92. Moreover, when the drive shaft 103 rotates, the cutter block 96 continues to fall. First, the projected portion 94 of the cutter 92 makes a cut in the perforations, which is a start of the cutting, and then its left and right tapered portions 95 cut open the perforations. When the crank 102 reaches bottom dead center, the tapered portions 95 complete the cutting of the continuous form over the full width thereof, and return to the highest position in the next half rotation, preparing for the next cut.

Incidentally, the cutter block 96, guide shaft 98, coil spring 99, connecting rod 101, crank 102 and the like are provided on both left and right sides, causing the cutter 92 and the paper presser 97 to move in parallel. In addition, since the cutter 92 is not a sharp blade, the form is cut in the perforations even though the perforations and the cutter 92 are not exactly aligned.

If the distance L between the drum transfer portion 58 and the cutter 92 is set so that it is an integral multiple of one unit amount of form feeding and an integral fraction of the "form length (entered from the operator panel 55)", it is easy to control the form feeding. Generally, the page length of a continuous form is N inches which is an integral multiple of one inch or 25.4 mm, so, if the above distance is set to n inches and one unit amount of form feeding is set to ½ inch, feeding of $2\times(N-n)$ pitches enables the perforations to be aligned with the cutter position. The operation of the continuous-form and cutform feeding unit 10 of this invention, when mounted on the printer main body 50, is described below.

(1) Continuous form mode operation

An operation is made possible in which, if the operator sets a continuous form in the tractor 13, it is fed to the continuous-form stacker 54 by the conventional automatic insertion function. Thereafter, printing and feeding are repeated, and the continuous form is accumulated in the stacker 54. If the end of the continuous form is sensed by a form end sensor 68, printing is stopped.

(2) Switching from the continuous mode to the cutform mode

This switching may be conducted by the operator manipulating the operator panel 55, or by a command 66 from the host as shown in FIG. 4.

If a command for "switching from the continuous mode to the cutform mode" is provided from the host, whether the continuous form is present in the printer or not is examined in a control circuit portion 69 of the printer. If the presence of the continuous form is detected, a command "cut the continuous form" is generated in the printer and sent to the continuous-form cutting means 17 of the continuous-form and cutform feeding unit 10, causing it to perform the cutting. The portion ahead of the cutting portion is ejected into the stacker 54. This is because it is necessary to empty the feeding passage for cutforms in the continuous-form and cutform feeding unit 10, which has only one form feeding passage 14.

Specifically, the form command sequencer 67, having received a command for "switching from the continuous-form mode to the cutform mode" utilizes the sensors 22, 62 and 64 for detecting the presence of the form in the form feeding passage 14 of the continuous-form and cutform feeding unit 10 and the form passage at the printer main body 50 to examine whether a signal sensing the presence of a continuous form is generated, and generates a command "cut the continuous form" if it detects the presence of a continuous form. This command is provided to the printer main body 50 and the continuous-form and cutform feeding unit 10 along with a series of other operation commands to be described as follows.

When the continuous form is to be stopped to prepare for the next printing when the perforations have arrived at the drum's transfer portion 58, the form feeding is performed while conducting the fixing operation of the toner, so that all the pages already printed are fixed. Subsequently, the feeding is further continued till the perforations arrive exactly under the cutter 92 of the continuous-form cutting means 17, and the form is temporarily stopped. When the "cut the continuous form" command is provided from the form command sequencer 67 through the form control portion 25 to the continuous-form cutting means 17, the cutting is performed. And the feeding means 61 on the form ejecting side of the printer main body 50 is operated so that the continuous forms which are in the form feeding passage 14 and in the form feeding passage of the printer main body 50 are all ejected into the continuous-form stacker 54. Since it is preferable to leave the subsequent continuous form in the tractor 13 for a later operation, the tractor 13 is kept stopped. At this point, a command signal for feeding cutforms is first sent to the form control portion 25, and the cutform mode operation is initiated.

(3) Cutform mode operation

The feed rollers 20 in the form feeding passage 14 are not engaged in the continuous-form mode, but, when switched to the cutform mode, a signal is sent from the form control portion 25 to a cam motor, not shown, and the feed rollers are engaged by the cam action so as to feed the form.

While cutforms are fed from the cassette 12 one by one, the feeding and printing are repeated. At this time, a well-known hopping roller and a roller for inhibiting simultaneous feeding in the cutform feeding means 11 operate under the control of the form control portion 25, having received the sense output of the cutform hopping sensor 23. Skew correction rollers 19 correct the skew of the outputted form, and after the leading edge of the form is abutted against the engaged portion of the rollers to correct the skew, the rollers are rotated to feed the cutform. Based on the sense output of the skew sensor 64, the printer is stopped if the skew amount is large.

(4) Switching from the cutform mode to the continuous-form mode

Since, in this switching, there is no cutform in the form feeding passage 14, merely switching to the continuous-form mode is sufficient.

Incidentally, concerning the "cut the continuous form" command, in addition to the case in which it is generated within the printer and issued when the command for "switching from the continuous-form mode to the cutform mode" is issued from the host as described above, there is also a case in which the "cut the continuous form" command is sent out from the host when the continuous form needs to be cut on a job-by-job basis. These are the cases in which cutting is conducted in response to a signal without operator intervention. In the apparatus of the embodiment, the "cut the continuous form" command can also be generated when the "cut the continuous form" switch or the switch for "switching from the continuous-form mode to the cutform mode" is pressed on the operator panel.

Since the continuous-form and cutform feeding unit of this invention can be automatically switched by a signal between a continuous form and cutforms, it does not need operator intervention for changing the form and can be used as a form feeding mechanism available for both types of forms for use with a printer directly connected to a computer. When unitized as a dualpurpose machine, there is also the effect that the need for purchasing two form feeding units, respectively dedicated to continuous forms and cutforms, is eliminated, and the time for changing the units can be saved. Also, since a user using only forms of one type need not provide an unnecessary cutter in the printer main body, and has only to purchase a continuous-form feeding unit having the minimum functions required and the printer main body, it is economical.

In this invention, since there is only one path for feeding forms to the printer main body, it has good compatibility with other form feeding units, and the structure of the printer main body also becomes simple and inexpensive.

There is also a secondary effect that the unitized construction of this invention makes maintenance and replacement easier, and it is also safe and easy to recover from paper jamming.

In addition, this invention has been described by supposing that the preferred application example is a printer, but it can be applied to a commonly used business machine such as a copying machine or a facsimile machine if a continuous form is required.

We claim:

1. An apparatus for feeding a continuous form and cutforms which is unitized and is able to be mounted on and removed from the main body of a business machine, comprising:

a single form feeding passage to the main body of said business machine, a cutform feeding passage for feeding cutforms to said single form feeding passage and a cutform feeding means located upstream thereof, a continuous-form feeding passage for feeding a continuous form to said single form feeding passage and a tractor for feeding a continuous form located upstream thereof, and a continuous-form cutting means provided in said continuous-form feeding passage, which operates in response to a signal for causing the continuous form to be cut so that cutforms can be fed after cutting and ejecting the continuous form if the cutforms are to be fed between uses of the continuous form.

2. An apparatus for feeding a continuous form and cutforms as claimed in claim 1 wherein said cutform feeding means includes a form cassette which can be mounted on and removed from said cutform feeding means.

3. An apparatus for feeding a continuous form and cutforms as claimed in claim 1 wherein said continuous form has perforations perpendicular to the moving direction of the continuous form, and said continuous-form cutting means cuts the continuous form along said perforations.

4. An apparatus for feeding a continuous form and cutforms which is contained in a single unit and is operable to be mounted upon and removed from the main body of a business machine, comprising:

a single form feeding passage to the main body of a business machine;

a cutform feeding passage for defining cutforms to the single form feeding passage;

means for feeding cutforms through the cutform feeding passage;

a continuous form feeding passage for feeding a continuous form to the single form feeding passage;

means for feeding a continuous form through the continuous form feeding passage;

continuous form cutting means in the continuous form feeding passage for cutting the continuous form in response to a signal;

means, responsive to a command to switch from feeding a continuous form to feeding cutforms, for determining if a continuous form is in the continuous form feeding passage; and means, responsive to a determination that a continuous form is in the continuous form feeding passage, for providing said signal to the continuous form cutting means, so that after it is cut the continuous form is fed out of the single form feeding passage permitting cutforms to be fed through the single form feeding passage.

* * * * *